United States Patent [19]

Mair et al.

[11] Patent Number: 4,739,711

[45] Date of Patent: Apr. 26, 1988

[54] HEAT SAVING COVER

[76] Inventors: William Mair, P.O. Box 357, R.R. #1, Mount Hope, Ontario L0R 1W0, Canada; George E. Morrison, 5085 Bayfield Crescent, Burlington, Ontario, Canada, L7L 3J5

[21] Appl. No.: 924,153

[22] Filed: Oct. 27, 1986

Related U.S. Application Data

[63] Continuation of Ser. No. 662,315, Oct. 18, 1984, abandoned.

[51] Int. Cl.[4] ..... B61D 39/00

[52] U.S. Cl. ..... 105/377; 49/221; 105/355

[58] Field of Search ..... 105/377; 49/221, 223, 49/425

[56] References Cited

U.S. PATENT DOCUMENTS

| | | | |
|---|---|---|---|
| 816,580 | 4/1906 | Hull | 49/225 |
| 835,392 | 11/1906 | Brock | 105/247 |
| 1,008,774 | 11/1911 | Beard | 49/225 |
| 1,136,971 | 4/1915 | Nylander | 49/225 |
| 1,342,612 | 6/1920 | Wood | 49/209 |
| 1,956,651 | 5/1934 | Moran | 49/425 X |
| 2,138,886 | 12/1938 | Schramm | 49/221 X |
| 2,269,630 | 1/1942 | Marinello | 49/221 X |
| 2,795,539 | 6/1957 | Hughes | 105/377 |
| 3,453,776 | 7/1969 | Weber et al. | 49/7 |
| 3,760,741 | 9/1973 | Belcher | 105/377 |
| 3,906,668 | 9/1975 | Simmons | 49/212 |
| 3,984,289 | 10/1976 | Sustarsic et al. | 105/377 X |
| 4,404,771 | 9/1983 | Murase et al. | 49/425 |

*Primary Examiner*—Robert B. Reeves
*Assistant Examiner*—Glenn B. Foster
*Attorney, Agent, or Firm*—Fleit, Jacobson, Cohn & Price

[57] ABSTRACT

A torpedo car for carrying molten iron has a cover to prevent loss of heat from the interior of the car. The cover is supported on a frame mounted at one end of the car and is slidable across the pouring latch to prevent heat loss. the cover is maintained at spaced relationship from the rotatable vessel in the closed position and is retractable to permit rotation about a horizontal axis.

7 Claims, 3 Drawing Sheets

HEAT SAVING COVER

This application is a continuation of application Ser. No. 662,315, filed Oct. 18, 1984, which is now abandoned.

This invention relates to covers for openings, and more specifically to a cover for a hatch in a container which is mounted on a vehicle and which is rotable about a longitudinal axis.

In the prior art, molten iron is transported from the furnace to the pouring station in a rail car upon which is mounted a cylindrical shaped container with conical ends. This container has an open hatch on the top into which the molten iron is poured. To pour the iron from the container, the hatch is lowered by rotating the container about a longitudinal axis.

A considerable amount of heat is lost through this hatch, causing the molten metal to cool durinq transport. After the metal is discharged, the refractory lining of the container will cool and after repeated heating and cooling it may deteriorate. The heat loss from the metal and the refractory lining considerably increases the energy consumption of the process and therefore increases its costs.

Attempts have been made to cover the hatch to reduce heat loss in the container. One method of covering the hatch is to throw a refractory blanket over it. This method is costly, however, as a new blanket must be used for every run.

It is an object of the present invention to obviate or mitigate the above disadvantages.

Accordingly, the invention provides a cover assembly to cover or uncover a hatch in the top of a container mounted on a vehicle and rotatable about a longitudinal axis comprising:

a support frame mounted on the vehicle at one end thereof such that it does not interfere with the rotational movement of the vehicle;

a cover movably mounted on the support frame said cover being moveable between an open position in which access to said hatch is unimpeded and a closed position where it overlies the hatch;

means for moving said cover between said opened or closed positions and;

guide means acting between the cover and hatch to maintain the cover and the hatch in a spaced relation in said closed position.

An embodiment of the invention will now be described with reference to the accompanying drawings in which.

Figure 1:
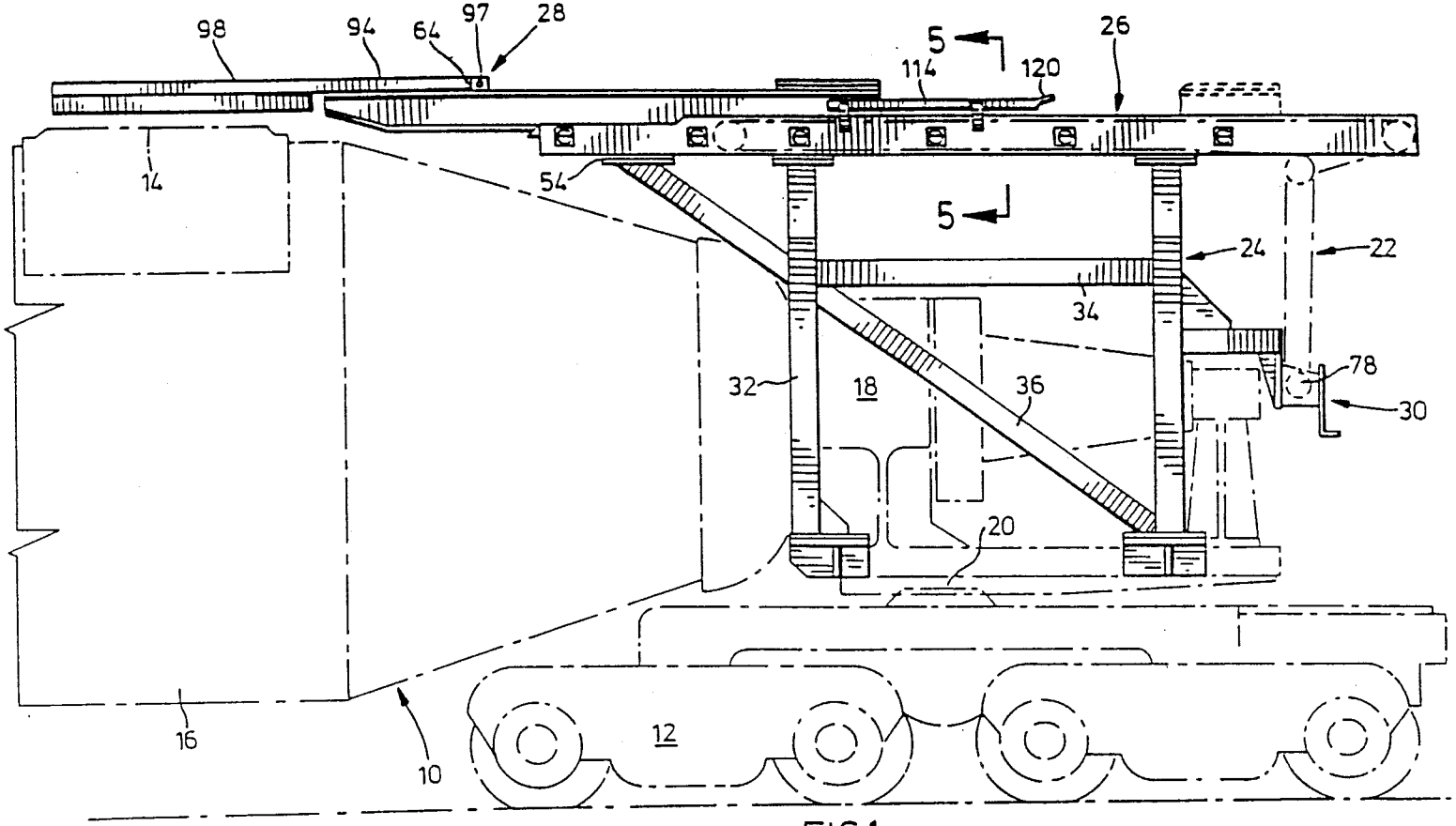
FIG. 1 is a side view of a cover assembly for an iron transportation vehicle with the vehicle being shown in ghosted outline.

Referring therefore to the drawings, a railroad vehicle 10 consists of a pair of trucks 12 (only one of which is shown) with a generally cylindrical vessel 16 extending between them. The vessel is attached to the trucks 12 by means of a trunion 18 that permits rotational movement of the vessel 16 about a generally horizontal axis relative to the trucks 12. Vertical steering motion of the trucks 12 relative to the vessel 16 is accommodated by a turntable 20.

The vessel 16 is provided with an open access hatch 14 to receive molten iron when in an upwardly directed position and to allow metal to pour out when the vessel 16 has been rotated so that the hatch 14 is directed downwardly.

The truck so far described is conventionally known as a tropedo truck in Schnabel type truck and as such will not be described in further detail.

Figure 2:
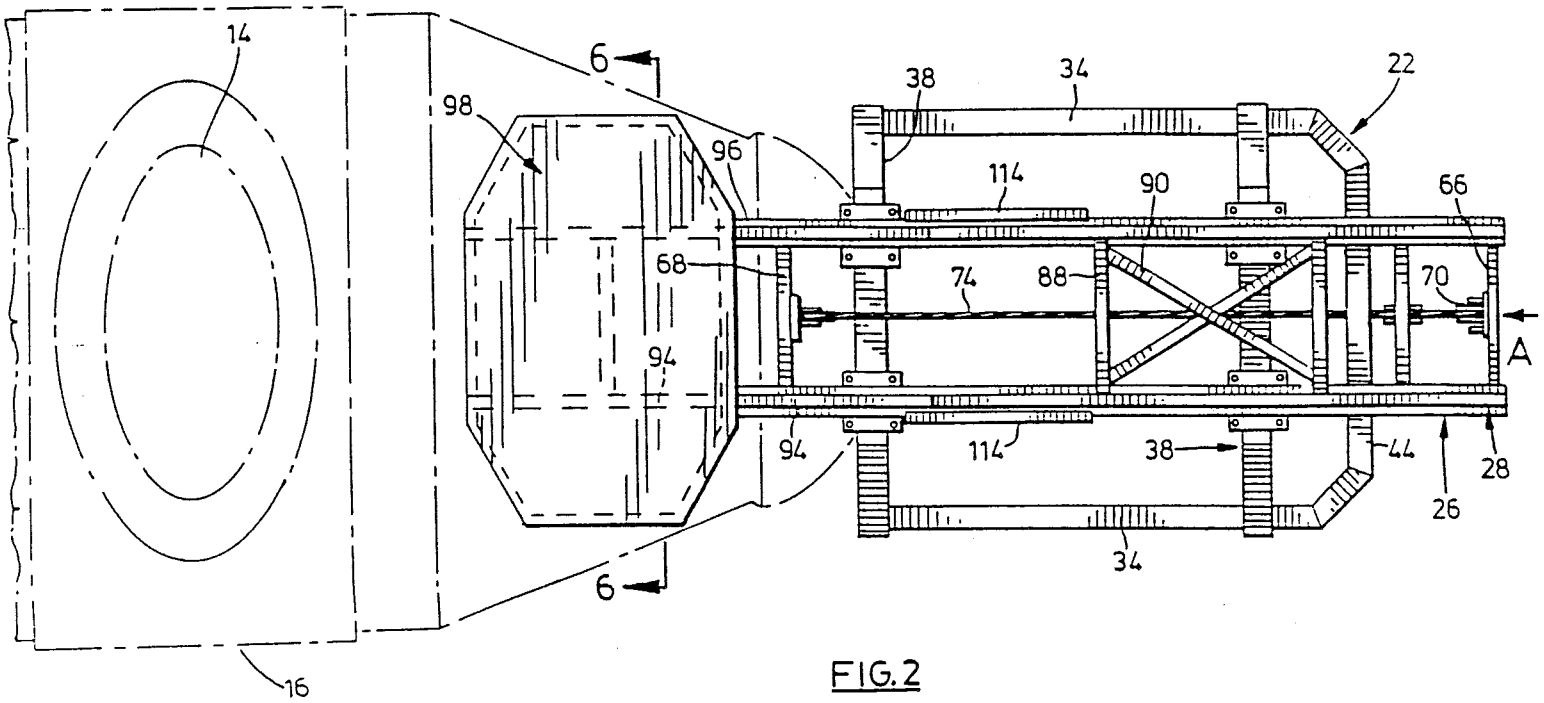
FIG. 2 is a plan view of the cover assembly of FIG. 1 in an alternate configuration.
Figure 4:
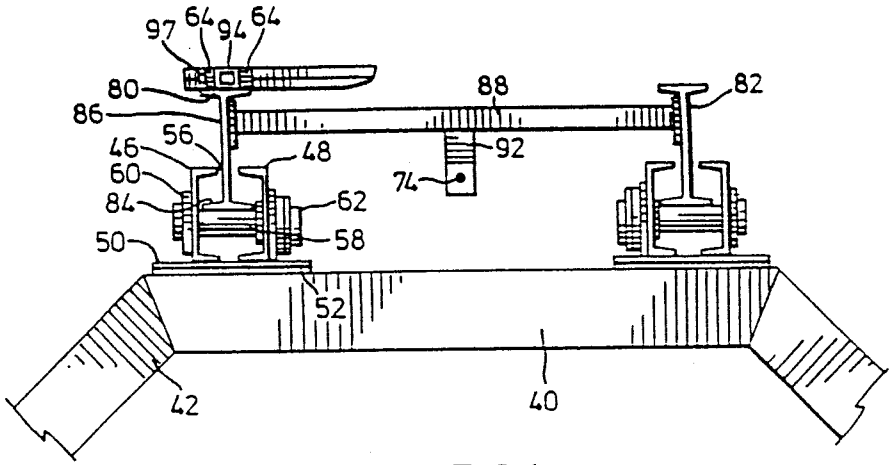
FIG. 4 is a similar view to FIG. 4, but on an enlarged scale of a portion of the cover assembly.

To reduce heat loss from the vessel 16 during transport, a cover assembly 22 is mounted on the vehicle at one end. The cover assembly 22 comprises a support frame 24 mounted on the platform 20 and supporting in an elevated position a pair of horizontal rails 26. Slidably supported on the rails 26 is a cover 28 that is moveable through a winch system 30 between a closed position shown in FIG. 1 in which the cover overlies the hatch 14 and an open position as shown in FIG. 2 in which access to the hatch is unimpeded.

The support frame 24 consists of four corner posts 32 that straddle the trunion 18. The posts 32 to each side of the trunion 18 are interconnected by a horizontal longitudinal beam 34 and a diagonal brace member 36 that projects upwardly beyond the post 32 to provide additional support for the rails 26. The posts 32 on opposite sides of the trunion are interconnected by generally transverse arch members 38 that consist of a horizontal transverse beam 40 and a pair of inclined beams 42. Also extending between the posts 32 is a transverse bracing beam to provide additional bracing.

Each of the rails 26 is formed from a pair of opposed channel members 46, 48 that are welded to pads 50 and bolted to corresponding pads 52 on the beam 40. The diagonal brace 36 is likewise attached to the forward end of the channels 46, 48 by means of pads 54.

The channel members 46, 48 are laterally spaced to provide an elongate slot 56 extendinq the length of the rails 26. The channel members also support a set of rollers 58 that are rotatably mounted in bearings 60, 62 in the channel members 46, 48 respectively.

The rails 26 are interconnected at opposite ends by cross-beams 66, 68 respectively. Cable pulleys 70, 72 are mounted on the mid-point of the beams 66, 68 so that the pulleys are rotatable about a transverse horizontal axis. A cable 74 is entrained around the pulleys 70, 72 and passes in opposite directions around a double pulley sheaf 76 mounted on the cross-beam 40 for connection to the drum 78 of the winch assembly 30. The cable 74 is used as a drive means to advance and retract the cover 28 that is slidably supported on the rails 26.

The cover 28 comprises a pair of longitudinally extending I beams 80, 82 whose lower flanges 84 are supported on the rollers 58. The web 86 of the I beams 80, 82 projects through the slot 56 above the channel members 46. To maintain the I beams 80, 82 in spaced parallel relationship, lateral braces 88 and diagonal braces 90 are welded between the flanges 86 above the level of the channel members 46, 48. Depending from the rearmost lateral brace 88 is a lug 92 that is attached to the cable 74 so that movement of the cable 74 induces longitudinal movement of the I beams 80, 82.

A pair of square section steel tubes 94, 96 are received between plates 64 to the upper surfaces of the I beams 80, 82 and secured by bolts 97. The tubes 94, 96, project forwardly of the I beam and may move upwardly from the beams. The tubes 94, 96 support a lid assembly 98.

Figure 6:
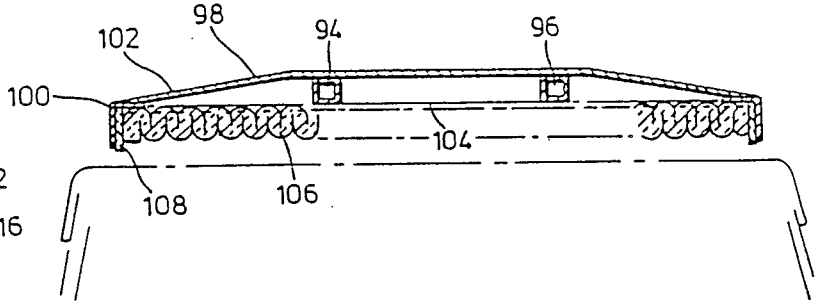
FIG. 6 is a section on the line 6—6 of FIG. 1.
Figure 3:
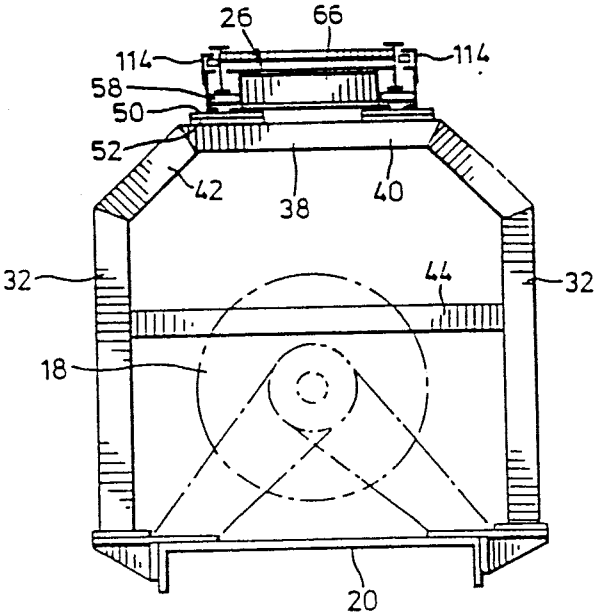
FIG. 3 is a view in the direction of arrow A of FIG. 2 of the cover assembly.

The details of the lid assembly can best be seen in FIG. 6. The lid includes a peripheral skirt formed from angle members 100 that are welded to the underside of the tubes 94, 96. A sheet metal cover 102 extends between the skirt members 100 and over the tubes 94, 96 so as to shed rain to either side of the lid 98. An expanded metal grid 104 also extends between the skirt members 100 beneath the tubes 94, 96 and acts as a support for a glass rock insulation 106 conventionally referred to as "Z block". Located between the insulation 106 and the angle members 100 is glass rock insulation board 108 that retards heat transmission to the angle members 100.

Figure 5:
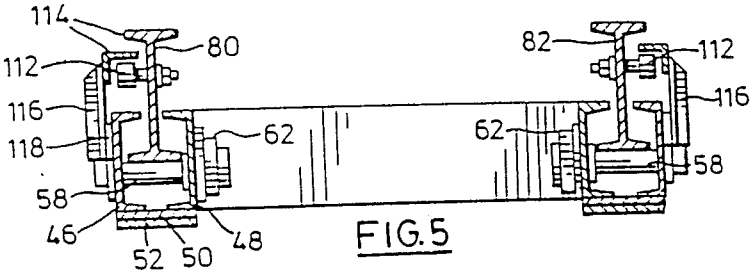
FIG. 5 is a section on the line 5—5 of FIG. 1.

To maintain the cover assembly 28 in spaced relationship from the hatch 14 guides are provided between the rails 26 and the cover 28 to prevent tilting of the I beams 80, 82. The details of the guides can best be seen in FIG. 5 where is will be seen that rollers 112 are attached to each of the webs 86 of the respective I beams so as to be located on the outwardly directed surface thereof. An angle member 114 is supported in spaced relationship from the upper surface of the I beam 46 by vertical straps 116. The straps are secured to the channel members 146 through spacer blocks 118 and support the angle member 114 over the roller 112. As can be seen in FIG. 1, the angle member 114 extends along the rails 26 and has an upwardly directed tail 120 formed at the rear of the angle member 114. The tail serves as a ramp to engage the roller 112 upon extension of the cover assembly 28 and ensure that it passes beneath the angle member 114.

When in the open position indicated in FIG. 2, the cover assembly is retracted from the hatch 14 and the I beams 80, 82 are supported along their length on the rollers 58. The recess 64 in the leading end of the channel members 46 accommodates the lid 98 and the frame 24 maintains the rails and cover assembly 26, 28 respectively above the trunion assembly 18.

With the cover assembly in the open position indicated, the vessel 16 may be rotated on a horizontal axis and the contents of the vessel 16 discharged through the hatch 14. When the vessel returns to the transport position with the hatch 14 upwardly directed, the cover may be moved to the closed position indicated in FIG. 1 through use of the winch assembly. Rotation of the winch drum 78 causes the cable 74 to move in a forward direction between the pulleys 70 and 72 and carry with it the cover assembly 28. The rollers 58 support the I beams 80, 82 so that a relatively low force is required to move the cover. As the cover 28 moves towards the closed position, the I beams 80, 82 are cantilevered forward of the rails 26. To prevent tipping of the cover 28 the roller 112 engages the underside of the angle member 114 and so secures the I beams 80, 82 to the rails 26. In this way the cover may be positioned over the hatch 14 without contacting the hatch and being subjected to the excessive temperatures and contamination that is likely to occur around the periohery of the hatch 14. The insulation on the underside of the lid 98 is effective to reduce convection and radiation through the hatch and thereby drastically reduce the heat loss within the vessel 16.

When a fresh charge is to be deposited in the vessel 16 it is simply necessary to retract the cover assembly 28 by means of the winch 30.

It will be seen therefore that a relatively simple yet effective cover assembly is provided which does not interfere with the normal operation of the truck 10 and yet is sufficiently robust to withstand the harsh working environment to which it is subjected.

It is claimed:

1. A cover assembly to cover selectively a hatch in a container which is mounted on a vehicle said container being rotatable about a longitudinal axis, said cover assembly comprising:

a support frame mounted at one end of the vehicle;

a cover moveably mounted on the support frame, said cover being moveable between an open position in which the hatch is uncovered and a closed position in which the cover is in cantilevered relation with respect to said support frame and overlies and is spaced from the hatch, the cover constituting a thermal barrier in said closed position to reduce heat exchange between the interior of the container and ambient air and to allow sufficient dissipation of heat through the opening to reduce excess damage to the cover due to heat buildup;

drive means acting between the cover and the support frame to move the cover between the and closed positions; and guide means acting between the frame and cover to maintain the cover in a spaced relationship above the hatch and container when in the closed position.

2. A cover assembly according to claim 1 wherein said cover is slidable relative to said support; said cover being slidable in a horizontal direction.

3. A cover assembly according to claim 2 wherein said cover is slidably mounted on longitudinally extending rails attached to said support frame.

4. A cover assembly according to claim 3 wherein said cover includes longitudinally extending beams cooperating with said rails, said guide means acting between said beams and said rails.

5. A cover assembly according to claim 4 wherein said guide means opposes tilting of said beams relative to said rails when said cover is in said closed position.

6. A cover assembly according to claim 5 wherein said beams are supported on rollers rotatably mounted on said rails.

7. A cover assembly according to claim 6 wherein said guide means includes a stationary member attached to said rails and wherein said guide means also includes a roller attached to said beam and engageable with a surface of said stationary member to prevent tilting of said beam.

* * * * *